US009149116B2

(12) United States Patent
Gasser

(10) Patent No.: US 9,149,116 B2
(45) Date of Patent: Oct. 6, 2015

(54) DRAWER STRUCTURE

(75) Inventor: Ingo Gasser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 13/560,031

(22) Filed: Jul. 27, 2012

(65) Prior Publication Data

US 2012/0286116 A1 Nov. 15, 2012

Related U.S. Application Data

(63) Continuation of application No. PCT/AT2011/000021, filed on Jan. 17, 2011.

(30) Foreign Application Priority Data

Feb. 3, 2010 (AT) ..... A 146/2010

(51) Int. Cl.
*A47B 96/07* (2006.01)
*A47B 88/00* (2006.01)

(52) U.S. Cl.
CPC ..... *A47B 88/0055* (2013.01); *A47B 2230/0014* (2013.01)
USPC ..... 312/348.4; 312/334.4; 312/334.5; 312/334.8; 248/221.11

(58) Field of Classification Search
CPC ..... A47B 88/0055; A47B 2088/0044; A47B 88/0051; A47B 2230/0014; A47B 2088/00
USPC ..... 248/221.1, 222.14, 225.11, 221.11, 248/222.12, 222.13; 312/330.1, 319.7, 312/334.8, 348.2, 348.4, 334.4, 334.5, 312/351.4, 351.7, 334.7
See application file for complete search history.

(56) References Cited

U.S. PATENT DOCUMENTS 4,609,236 A 9/1986 Twellmann
4,705,328 A * 11/1987 Rock et al. ..... 312/330.1
5,163,774 A * 11/1992 Lautenschlager ..... 403/245
5,505,554 A 4/1996 Lautenschlager et al.
5,860,718 A * 1/1999 Brustle ..... 312/348.2
(Continued)

FOREIGN PATENT DOCUMENTS

AT 304 802 1/1973
AT 359 684 11/1980
(Continued)

OTHER PUBLICATIONS

International Search Report issued May 18, 2011 in International (PCT) Application No. PCT/AT2011/000021.
(Continued)

*Primary Examiner* — Tan Le
(74) *Attorney, Agent, or Firm* — Wenderoth, Lind & Ponack, L.L.P.

(57) ABSTRACT

A drawer structure (5) includes a fixing device (6) for fixing a front panel (7) to a drawer container (8) in a detachable and position-adjustable manner. The front panel (7) can be detachably connected to the fixing device (6) by means of a connection element (9) pre-mounted on the front panel (7). A first adjusting element (1) is associated with the container (8), for adjusting the position of the front panel (7) in the vertical direction (HR), and a second adjusting element (2) is associated with the container (8), for adjusting the position of the front panel (7) in the lateral direction (SR), at least the first (1) and second (2) adjusting elements engaging with the same part of the connection element (9).

20 Claims, 11 Drawing Sheets

(56) References Cited

U.S. PATENT DOCUMENTS

| | | | | |
|---|---|---|---|---|
| 6,457,791 | B1 * | 10/2002 | Muterthies et al. | 312/348.4 |
| 8,038,234 | B2 * | 10/2011 | Weber | 312/348.4 |
| 8,262,175 | B2 * | 9/2012 | Lam et al. | 312/348.4 |
| 2009/0058243 | A1 | 3/2009 | Weber | |
| 2012/0286116 | A1 * | 11/2012 | Gasser | 248/221.11 |
| 2012/0306337 | A1 * | 12/2012 | Hammerle | 312/334.8 |

FOREIGN PATENT DOCUMENTS

| | | |
|---|---|---|
| CN | 1968625 | 5/2007 |
| CN | 101543346 | 9/2009 |
| DE | 85 31 752 | 4/1986 |
| DE | 36 20 450 | 1/1987 |
| DE | 43 05 074 | 8/1994 |
| DE | 20 2007 011 518 | 10/2007 |
| EP | 0 096 898 | 12/1983 |
| EP | 0 624 733 | 11/1994 |
| EP | 1 639 917 | 3/2006 |
| EP | 1 708 591 | 10/2006 |
| WO | 2009/006651 | 1/2009 |

OTHER PUBLICATIONS

Austrian Patent Office Search Report completed Aug. 3, 2010 in Austrian Patent Application No. A 146/2010.

Russian Office Action (OA) issued Jul. 18, 2014 in parallel Russian Application No. 2012 137 214.

* cited by examiner

1
A
13
10
22
26
A (2 : 1)

2
B
22
14
10
SSR
25
B (2 : 1)

4
C
24
23
22
12
SSR
C (2 : 1)

SR
12
22
10
18
1
22
13
29
18

E(2:1)
13
10
SR
22
18
E
19

F(2:1)
22
10
13
18
F
19

DRAWER STRUCTURE

This application is a Continuation of International Application No. PCT/AT2011/000021, filed Jan. 17, 2011, the entire disclosure of which is incorporated herein by reference.

BACKGROUND (1) Field of the Invention

The invention concerns a drawer frame structure comprising a fixing device for fixing a front panel to a drawer container in releasable and positionally adjustable relationship, wherein the front panel can be releasably connected to the fixing device by way of a connecting element which can be pre-mounted to a front panel and wherein a first adjusting element is associated with the container for adjusting the position of the front panel in the heightwise direction, as well as a drawer having such a drawer frame structure and an article of furniture having a drawer with drawer frame structure.

(2) Description of Related Art

Drawer frame structures generally form a part of a drawer that imparts stability thereto. In most cases those drawer frame structures are in the lateral lower regions of the drawer where the drawers are mounted on extension guides, the extension guides themselves in turn being mounted in a carcass of an article of furniture.

As is known from WO 2009/006651 A2 concerning the general kind of drawer frame structure, arranged in the region of the drawer frame structure that faces in the direction of front panels, is a fixing device to which a front panel is fixed. In addition, arranged in the region of the fixing device are various displacement mechanisms permitting positional adjustment of the front panel for example in heightwise, lateral and inclination directions. In that respect the adjusting elements are associated with the container (frame structure) for adjustment of height and inclination, while the adjusting element for lateral adjustment is associated with the front panel. As can be seen in that specification, that entire mechanism requires a relatively large amount of space in the fixing region and is of a complicated and expensive structure involving very many parts.

DE 43 05 074 A1 basically shows a drawer panel fixing fitment which allow heightwise and lateral adjustment of the front panel relative to the drawer side wall. In that case heightwise adjustment is effected by a holding projection and a screw in relation to a fixing part (longitudinal slot). The height can also be fixed by a threaded pin. In comparison lateral transverse adjustment of the front panel is effected directly with a fixing part which is connected to the front panel—and thus associated with the front panel and not the drawer or its side wall—and there by way of the slots. A transverse displacement along the slots can only be effected by hand without an actual adjusting element when the fixing screws are loosened.

In the same fashion, that also applies to AT 304 802 B which is of a different general kind of device. In accordance with that specification, there are only slots for lateral adjustment between a carrier plate and the front panel. A screw responsible for heightwise adjustment in connection with an opening is not associated with the container as in the release position of the front panel with pre-mounted carrier plate, the screws remain in threaded bores in the carrier plate—and thus associated with the front panel.

DE 85 31 752 U1 which relates to a different kind of device also provides that the adjusting screws present are associated with the connecting element (holding part). In addition there is not an actual adjusting element for lateral displacement.

DE 20 2007 011 518 U1 which relates to a different kind of device also provides bolts for heightwise and lateral adjustment associated with a device connected to the front panel. In other words the connecting element can only be released with the bolts from a carrier member associated with the container or from the frame structure, whereby no adjusting elements are associated with the container.

In a similar fashion EP 1 639 917 A1 which relates to a different general kind of device also shows screws associated with the connecting element, wherein moreover there is no teaching in respect an actual lateral adjusting element.

BRIEF SUMMARY OF THE INVENTION

The object of the invention is to provide a drawer frame structure with fixing device, that is improved over the state of the art, that is of a less complicated and expensive structure and that is simplified. In particular the invention seeks to provide that the space required is reduced. Nonetheless functionality in respect of releasing and positionally adjusting the front panel should essentially be retained.

For a drawer frame structure according to the invention that object is attained in that a second adjusting element is associated with the container for adjusting the position of the front panel in the lateral direction, wherein at least the first and second adjusting elements engage the same part of the connecting element. Particularly if the part of the connecting element, that is engaged by the first and second adjusting elements, is formed in one piece and of a substantially plate-shaped configuration, that affords a very narrow orientation for the fixing device. In particular the drawer frame structure is thereby not widened in the lower region, in relation to the state of the art, whereby the entire drawer wall is no wider than 15 mm. Preferably the width is less than 11 or even only at a maximum 8 mm.

Preferably the part of the connecting element that is engaged both by the first and also the second adjusting element is formed in one piece. It is however also certainly conceivable for the said part of the connecting element to comprise a plurality of portions which have a fixed, non-displaceable positional relationship with each other in the assembled condition and nonetheless form the same part.

Preferably it can be provided that the plate-shaped part has recesses, wherein the adjusting elements engage into said recesses.

A further preferred variant of the invention can provide that upon displacement of the second adjusting element, preferably in the form of a worm, the plate-shaped part is moved in the lateral direction with respect to the container and upon displacement of the first adjusting element, preferably in the form of an eccentric, the plate-shaped part is moved in the heightwise direction with respect to the container. To permit those movements of the different adjusting elements on the same plate-shaped part sufficient clearance must be provided in relation to the adjusting element which is precisely not being actuated—in contrast to the state of the art—in order not to impede displacement by the other adjusting element. For that purpose it can preferably be provided that on the one hand there is clearance between the second adjusting element and the recess of the plate-shaped part in the heightwise direction and said clearance allows displacement of the first adjusting element in the heightwise direction and on the other hand there is clearance between the first adjusting element and the recess of the plate-shaped part in the lateral direction and said clearance allows displacement of the second adjusting element in the lateral direction.

In order generally to permit release and connection of the front panel to the drawer frame structure it can preferably be provided that a locking device is associated with the container for releasably fixing the front panel to the drawer frame structure, wherein the connecting element is releasable from the container by displacement of the locking device from a locking position into a release position. In that case there can also be provided a resiliently mounted catch portion which upon entry of the connecting element of the front panel automatically pulls it to the drawer frame structure, whereupon locking takes place.

To achieve a design configuration which is as narrow as possible even when a locking device is provided it is preferably provided that the locking device also engages the plate-shaped part of the connecting element. In this case also there should be sufficient clearance for lateral and heightwise displacement of the other adjusting elements.

It should not be excluded for the invention that there is provided a third adjusting element preferably also engaging the plate-shaped part of the connecting element for adjustment of the inclination of the front panel.

Preferably it can further be provided that the adjusting elements and the locking device are adapted to be rotatable, preferably actuably by a screwdriver, displaceable and self-locking. In that case the individual adjusting elements and the locking device can be reached by a screwdriver either from the outside or from the inside.

As a drawer is fixed at its two side regions to an extension guide, drawer frame structures are usually present in a drawer at both sides. In that case the drawer frame structure according to the invention with the fixing device can be present only at one side or also at both sides. At any event the front panel should also permit the adjustments made, at the other drawer frame structure. If the adjusting elements or locking device are provided on both sides then adjustment should be effected at both sides.

BRIEF DESCRIPTION OF THE DRAWINGS

Further details and advantages of the present invention are described more fully hereinafter by means of the specific description with reference to the embodiments illustrated in the drawings in which.

DETAILED DESCRIPTION OF THE INVENTION

Figure 1:
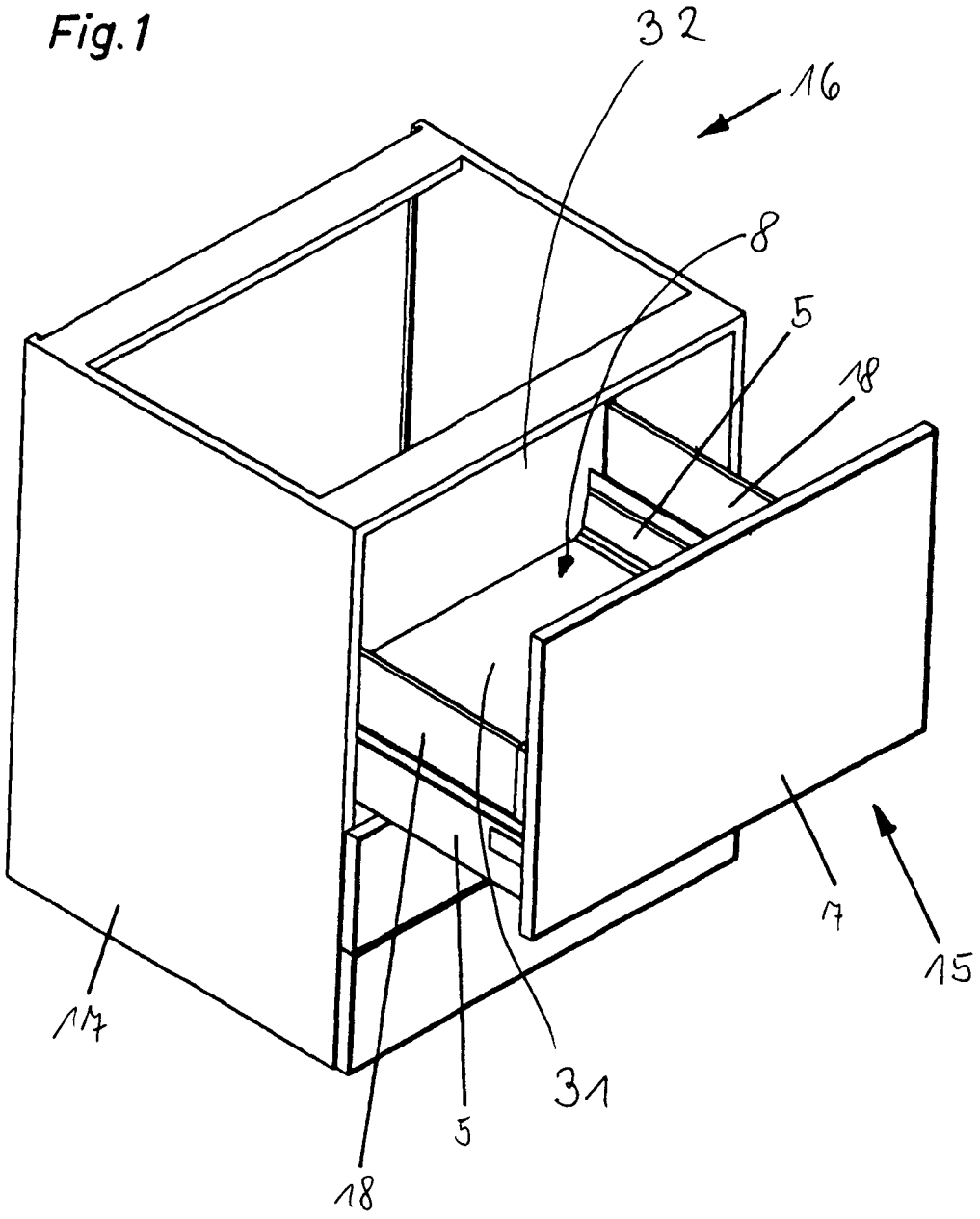
FIG. 1 shows a view of an article of furniture.

FIG. 1 shows an article of furniture 16 comprising a furniture carcass 17 and drawers 17 which can be pushed in and pulled out in the furniture carcass 17. In this case the drawer 15 substantially comprises the drawer container 8 and the front panel 7, the drawer container 8 including a drawer bottom 31, the drawer back wall 32 and the drawer frame structure 5 together with frame structure fitment 8. The drawer frame structure 5 is shown in FIG. 1 as being as wide as in the state of the art, which involves a small filling volume for the drawer 15.

Figure 2:
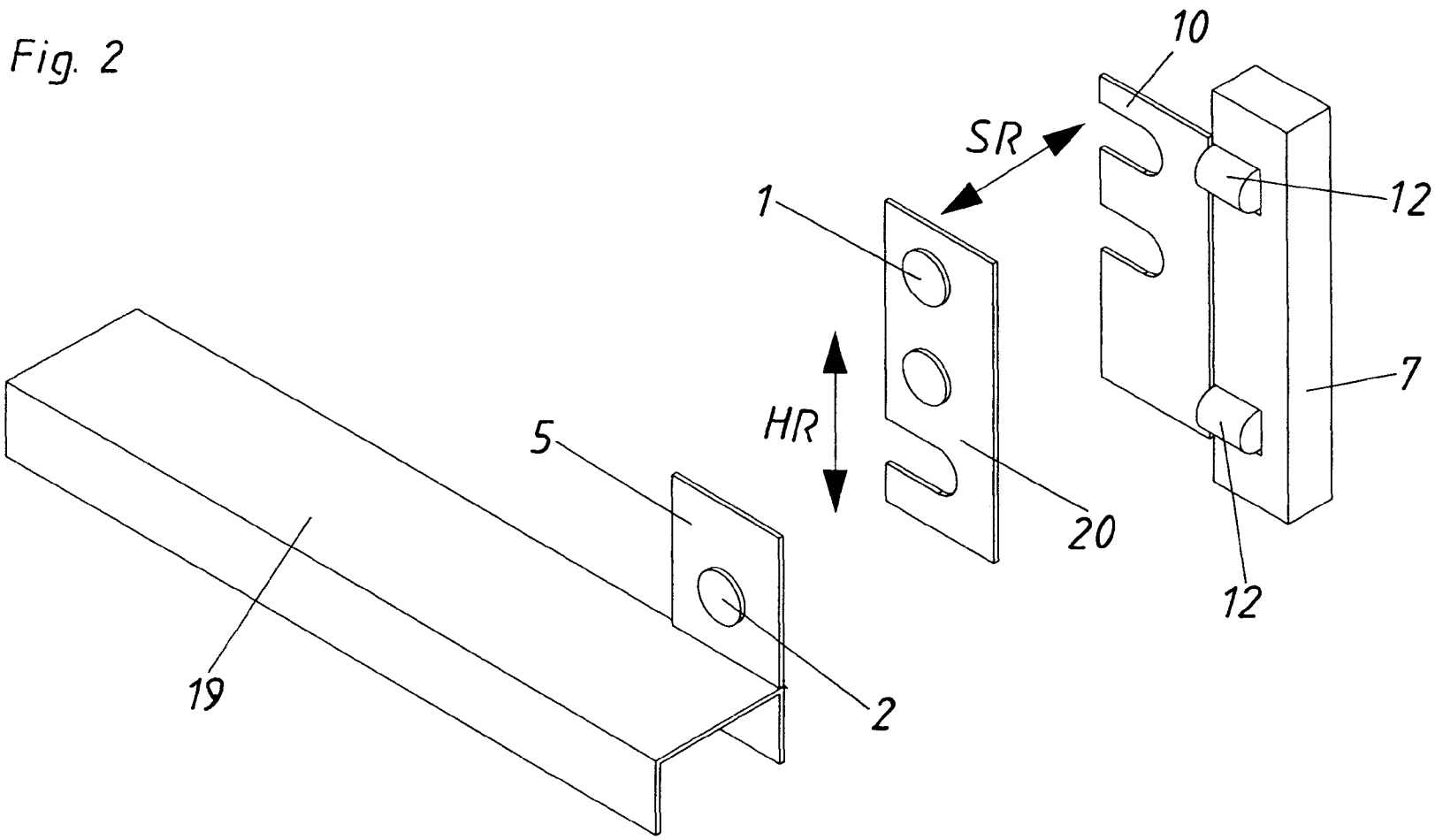
FIG. 2 shows a diagrammatic view of the fixing device according to the state of the art.

FIG. 2 diagrammatically shows a part of the drawer frame structure 5, that is connected to a container rail 19, and a first adjusting element 2 for displacement of an intermediate plate 20 in the heightwise direction HR. Arranged on that intermediate plate 20 is a further adjusting element 1 for displacement of the front panel 7 by way of the connecting element 10 in the lateral direction SR.

Figure 3:
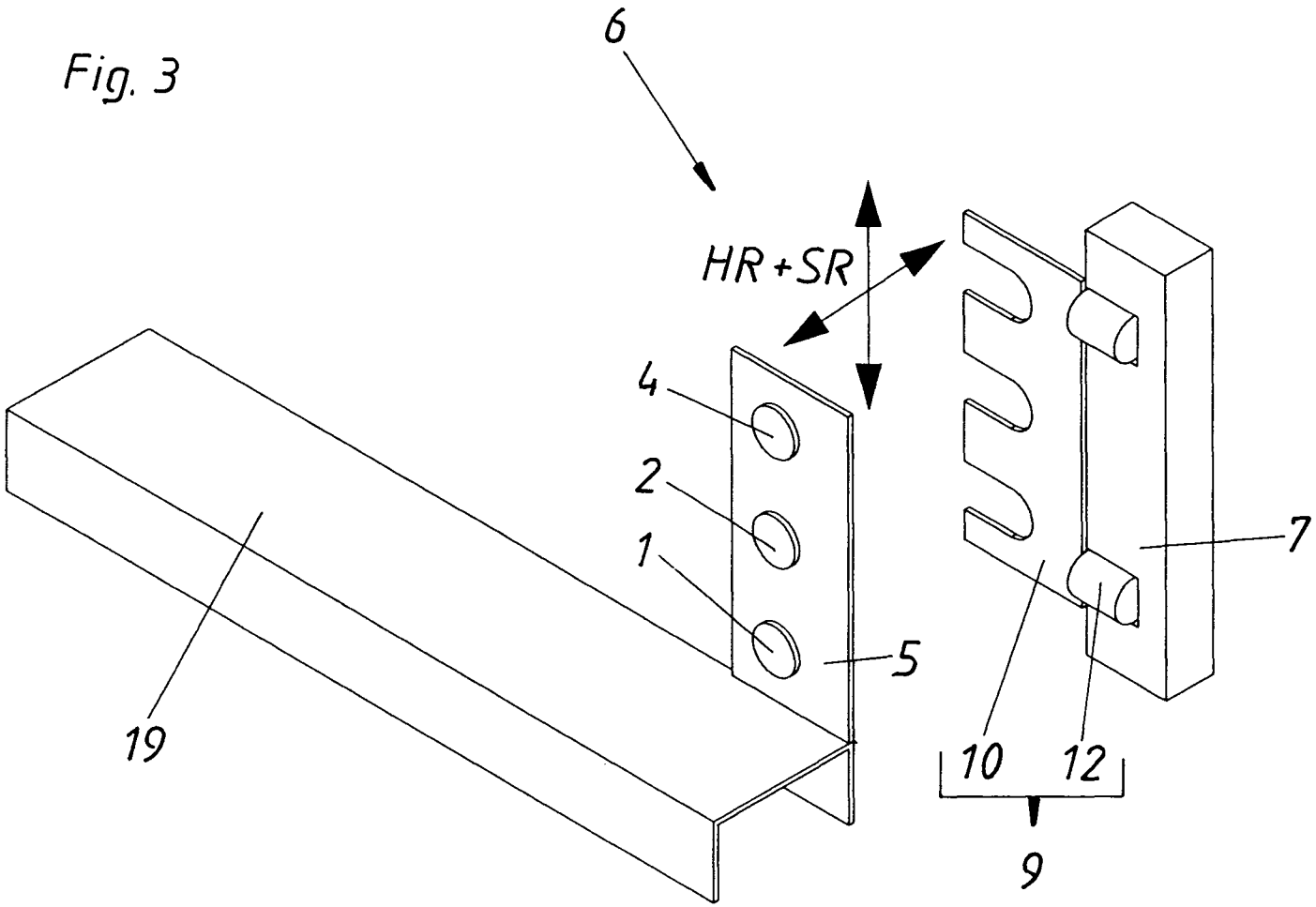
FIG. 3 shows a diagrammatic view of the fixing device according to the invention.

As shown in FIG. 3 according to the invention that intermediate plate 20 which is shown in FIG. 2 is no longer required. Rather, associated with the drawer frame structure 5 are at least two adjusting elements 1 and 2 for displacement in the lateral direction SR and the heightwise direction HR, which both engage the same part 10 of the connecting element 9 and by virtue of the displacement of that plate-shaped part 10 by way of the holding extensions 12 (preferably in the form of pegs) change the position of the front panel 7 with respect to a drawer container 8. In addition the fixing device 6 can also have a locking device 4 preferably engaging the same plate-shaped part 10 of the connecting element 9. In accordance with the present invention the expression "associated with the container" means that the adjusting elements 1 and 2, with the front panel 7 removed (with the connecting element 9 mounted thereto) are arranged at the drawer 8 (or the frame structure 5 and the fixing device 6 thereof).

Figure 4:
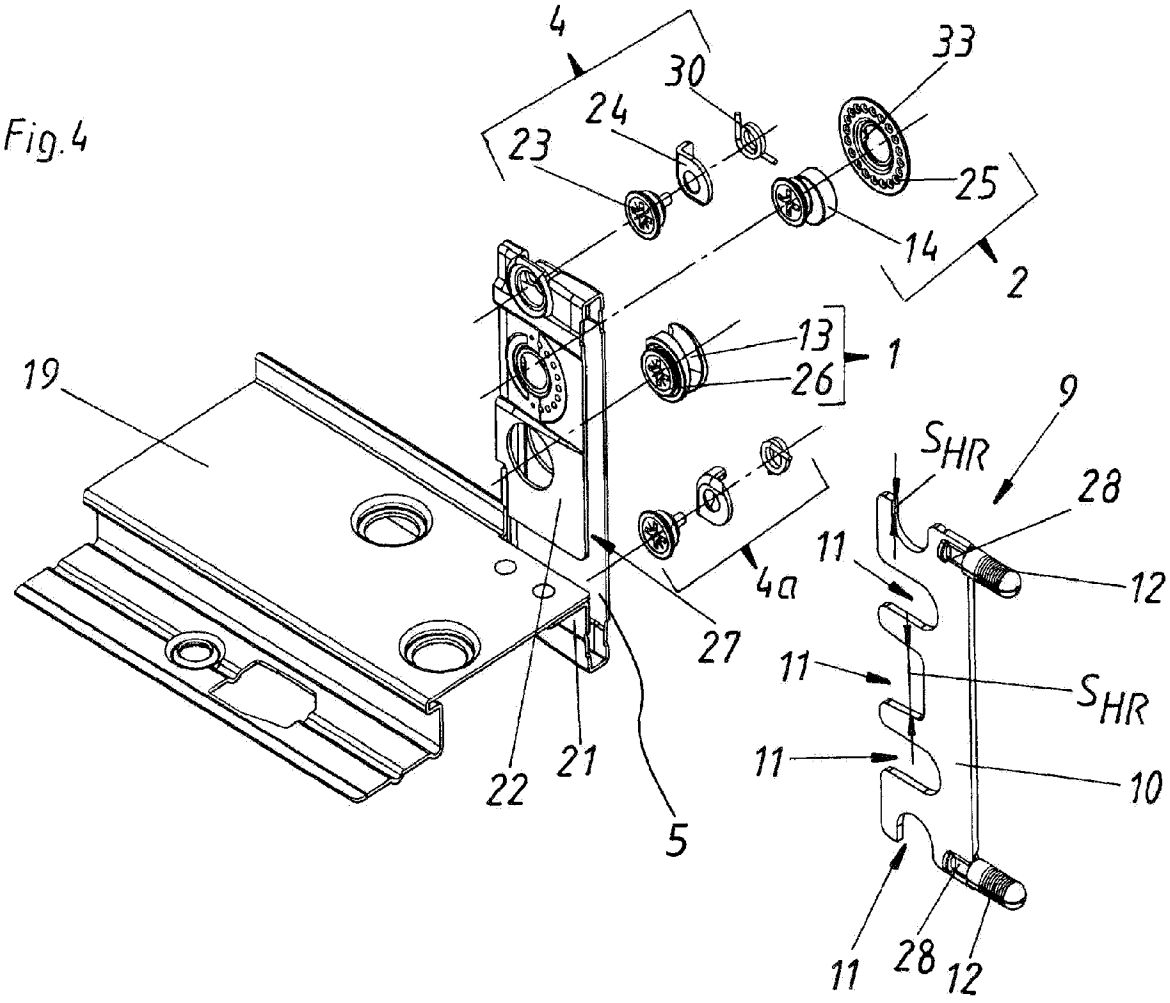
FIG. 4 shows an exploded view of the drawer frame structure with fixing device.

FIG. 4 shows the essential component parts of the fixing device 6 of the drawer frame structure 5 in an exploded view. At the container side in that case the fixing device 6 substantially includes the U-shaped profile member 22, in which the individual adjusting elements 1 and 2 and the locking devices 4 and **4*a* are arranged, and at the front panel side the connecting element 9. The drawer frame structure 5 substantially comprises the U-shaped profile member 22 and the elongate base portion 21 extending from the front of the drawer container to the rear side. Mounted to that drawer frame structure is a container rail 19 disposed at the underside of the drawer bottom 31, by way of which the entire drawer 15** can be fixed to an extension guide (not shown).

Essential parts of the fixing device 6 are the second adjusting element 1 which includes the worm 13 and the actuating member 26, the first adjusting element 2 for displacement in the heightwise direction HR, including the eccentric 14 and the positioning nut 25, and the two locking elements 4 and **4*a* which respectively include the locking screw 23, the locking element 24 and the locking spring 30. When the front panel 7 is fitted the connecting element 9 mounted thereon is introduced into the receiving means 27 of the U-shaped profile member 22. That connecting element 9 has a plate-shaped part 10 with various recesses 11 which respectively engage the individual adjusting elements 1 and 2 or the locking devices 4 and 4***a* respectively. The holding extensions 12 are slightly elastically bendably connected to the plate-shaped part 10 by way of bending elements 28. The recesses 11 which correspond to the locking devices 4 and 4*a* and the second adjusting element 1 have sufficient clearance $S_{HR}$ in the heightwise direction HR to allow heightwise displacement with the first adjusting element 2 which engages into the second recess 11 viewed from the top.

Figure 5:
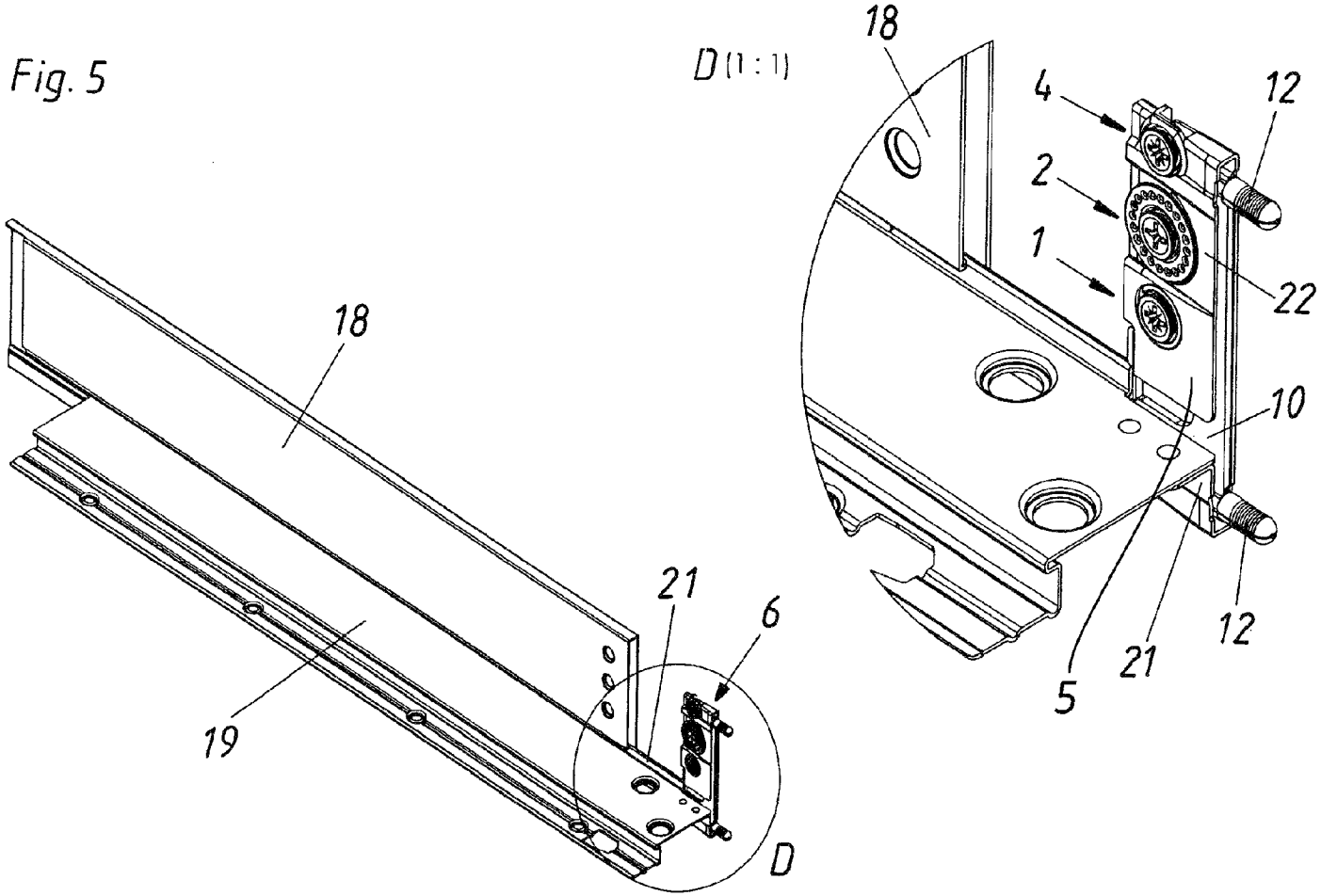
FIG. 5 shows the drawer frame structure with fixing device in the assembled condition.

The uniformly wide and at the same time relatively narrow configuration of the fixing device 6 can be clearly seen in FIG. 5. In that way a likewise narrow and uniformly wide frame structure attachment 18 can be mounted to the base portion 21 and by way of the U-shaped profile member 22 of the drawer frame structure 5. In comparison in particular FIG. 3 of WO 2009/006651 A2 shows a drawer frame structure which becomes progressively wider in the lower region as all the parts of the fixing device would otherwise not have space whereby the internal space in the drawer container is also substantially reduced.

The detail D shows the fixing device 6 in the assembled condition, wherein the plate-shaped part 10 of the connecting element 9 are connected by way of those recesses 11 with the individual adjusting elements 1, 2 and the locking device 4 with the drawer frame structure 5.

Figure 6:
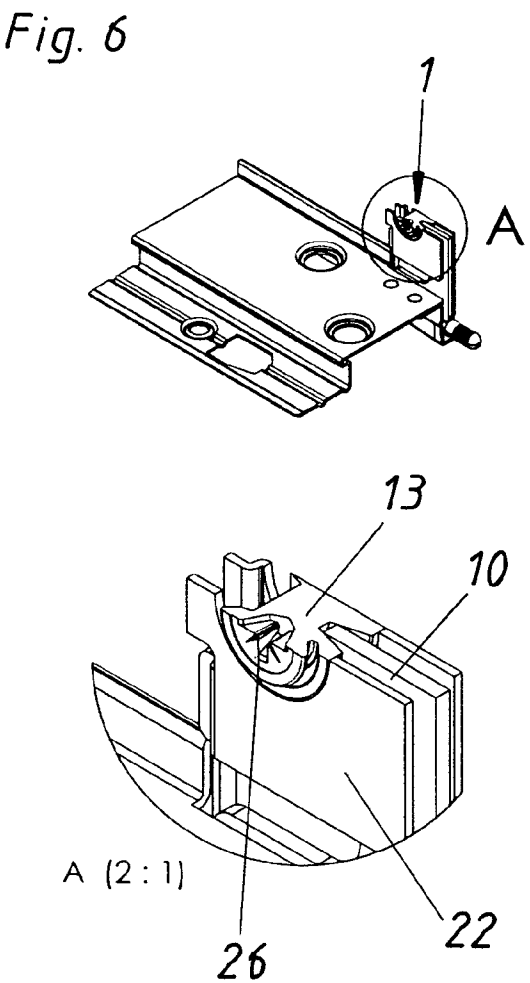
FIG. 6 shows a section through the lateral adjusting element in the normal position.

In FIG. 6 the section A through worm 13 shows the normal position of the plate-shaped part 10 without displacement in the lateral direction SR.

Figure 7:
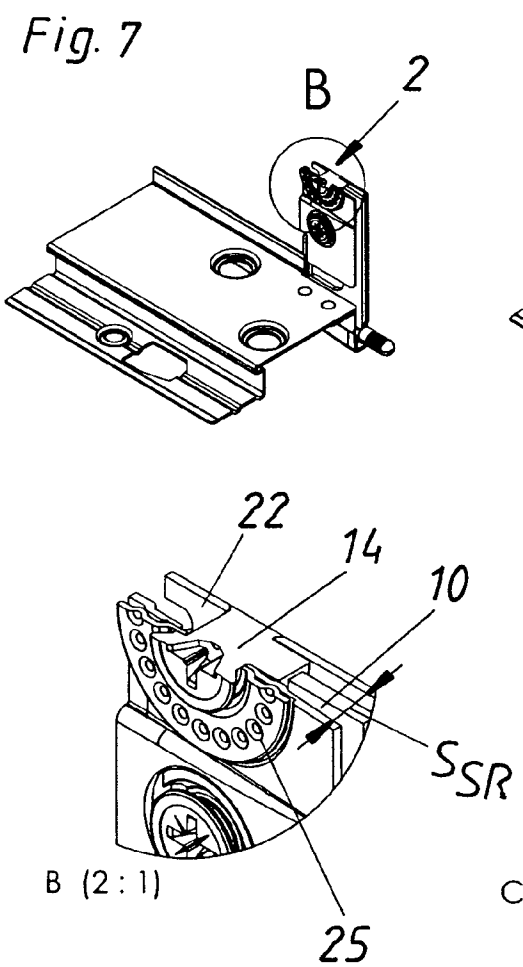
FIG. 7 shows a section through the heightwise adjusting element in the normal position.

In FIG. 7 the detail section B through the first element 2 and its eccentric 14 shows the normal position of the plate-shaped part 10 in the heightwise direction HR, wherein there is already sufficient clearance $S_{SR}$ for displacement in the lateral direction SR. The positioning nut 25 has numerous knobs which can latch in corresponding depressions on the U-shaped profile member 22 (see FIG. 4), thereby giving a self-locking action after displacement of the eccentric 14.

Figure 8:
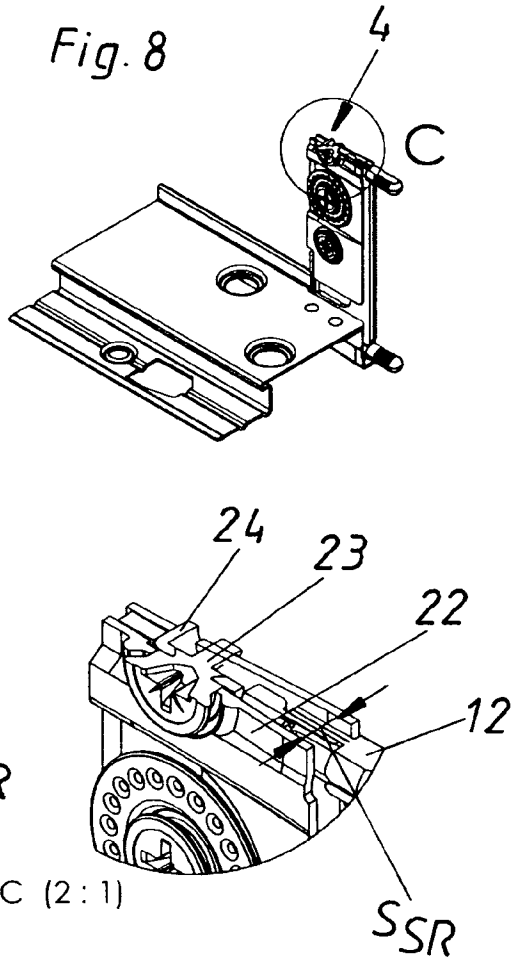
FIG. 8 shows a section through the locking device in the locked condition.

In FIG. 8 the detail section C shows a section through a locking screw 23 of the locking device 4, the locking element 24 engaging in the locking position V on the part 10. In this region also the plate-shaped part 10 has sufficient clearance $S_{SR}$ in the lateral direction SR in the U-shaped profile member 22 to permit lateral displacement by the second adjusting element 1.

Figures 9, 10, 11:
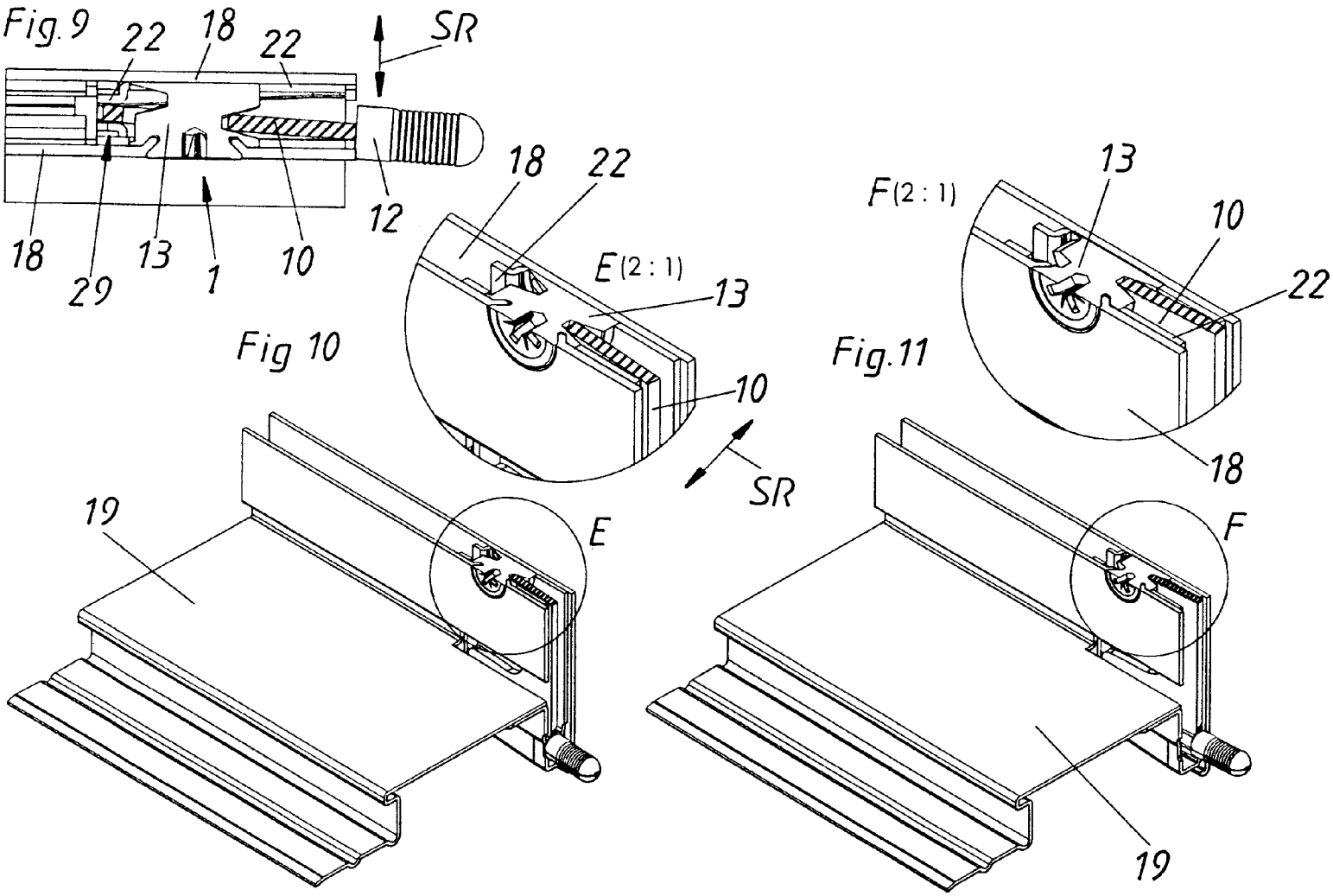
FIG. 9 shows a plan view of the sectional region through the lateral adjusting element.
FIGS. 10 and 11 show views of the extreme positions of the lateral adjusting element.

FIG. 9 shows that lateral displacement, wherein the plate-shaped part 10 of the connecting element 9 passes upon insertion into the receiving means 27 into a clamping region 29 between the two sides of the U-shaped profile member 22. The plate-shaped part 10 is moved out of the position in FIGS. 9 and 10 into the position shown in FIG. 11 by rotation of the worm 13 of the adjusting element 1, whereby the position of the front panel 7 relative to the container 8 is altered. In that case there is so-to-speak a pivotal movement of the plate-shaped part 10 about the clamping region 29. To compensate for the inclined position, shown in extreme form in FIG. 9, of the holding extension 12 in the front panel 7 the bending elements 28 (see FIG. 4) are provided in the connecting region between the holding extension 12 and the plate-shaped part 10.

As can be seen in FIGS. 9 through 11 the frame structure attachment 18 is already fitted over the entire fixing device 6 and the U-shaped profile member 22, wherein the individual adjusting elements 1 and 2 or the locking device 4 respectively are accessible through the openings in the frame structure attachment 22. In that case—in contrast to the illustrated embodiments—actuation can also be from the outside.

Figure 13:
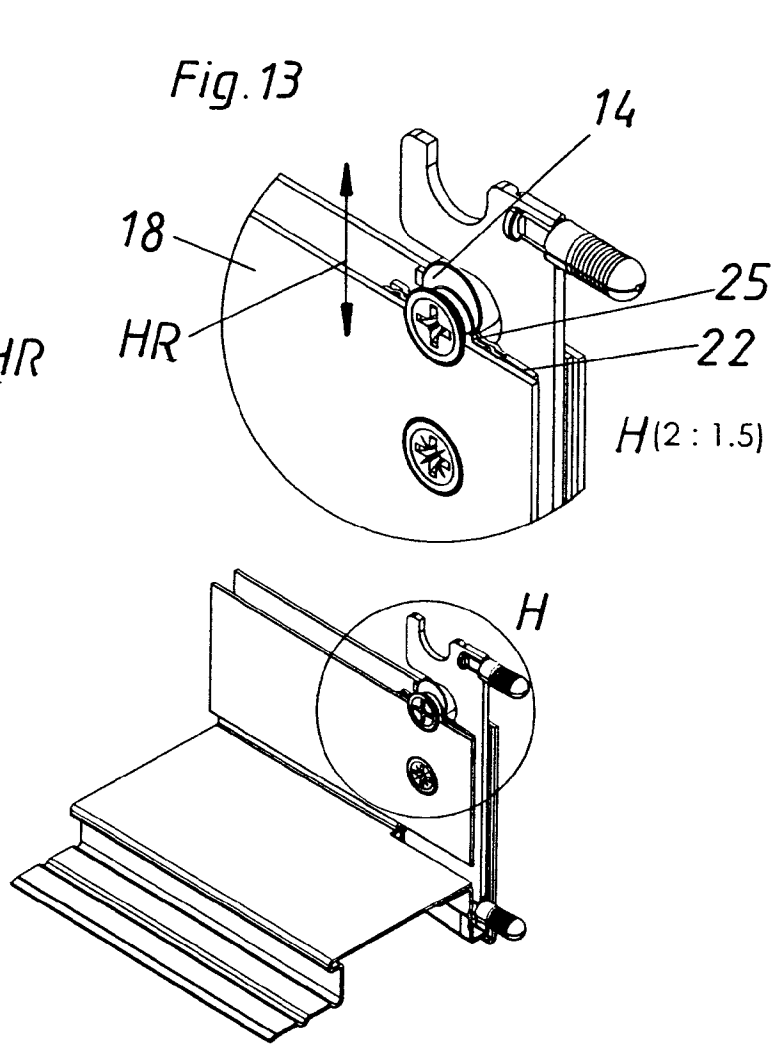
FIGS. 12 and 13 show views of the extreme positions of the heightwise adjusting element.
Figure 12:
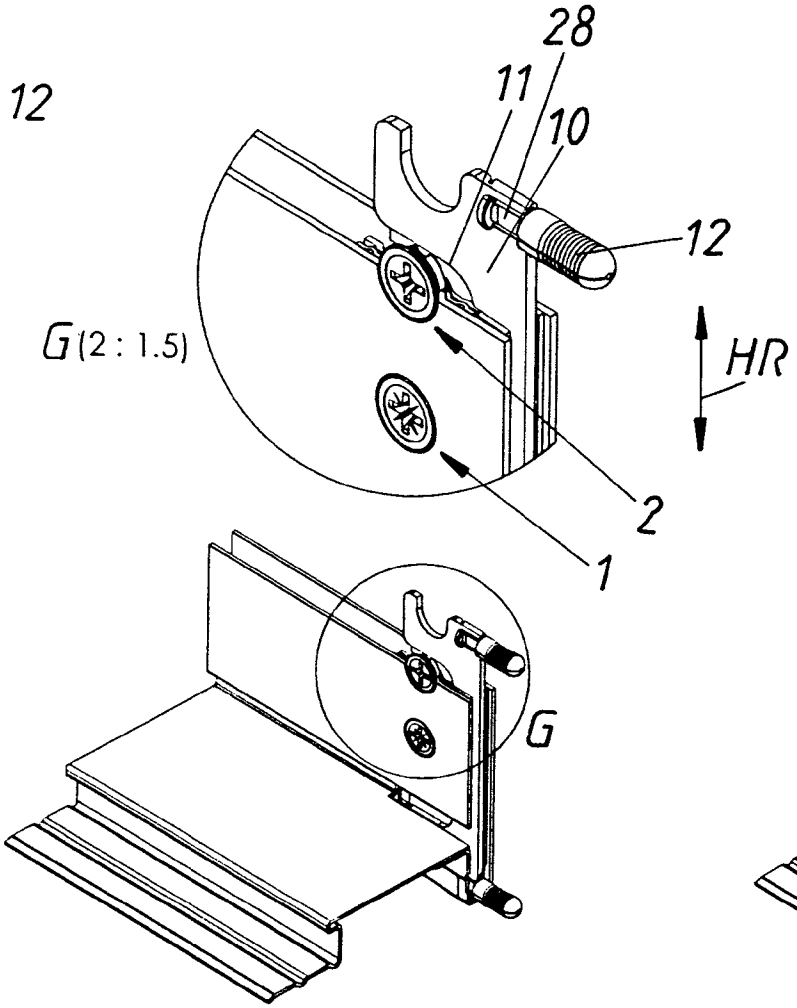

FIGS. 12 and 13 show extreme positions of the first adjusting element 2, wherein, in accordance with detail G, the plate-shaped part 10 is arranged entirely downwardly in the heightwise direction HR in relation to the U-shaped profile member 22 and in FIG. 3 the plate-shaped part 10 is arranged entirely upwardly in the heightwise direction HR in relation to the U-shaped profile member 22. The plate-shaped part 10 is moved upwards and downwards by rotation of the eccentric 14.

Figures 14, 15:
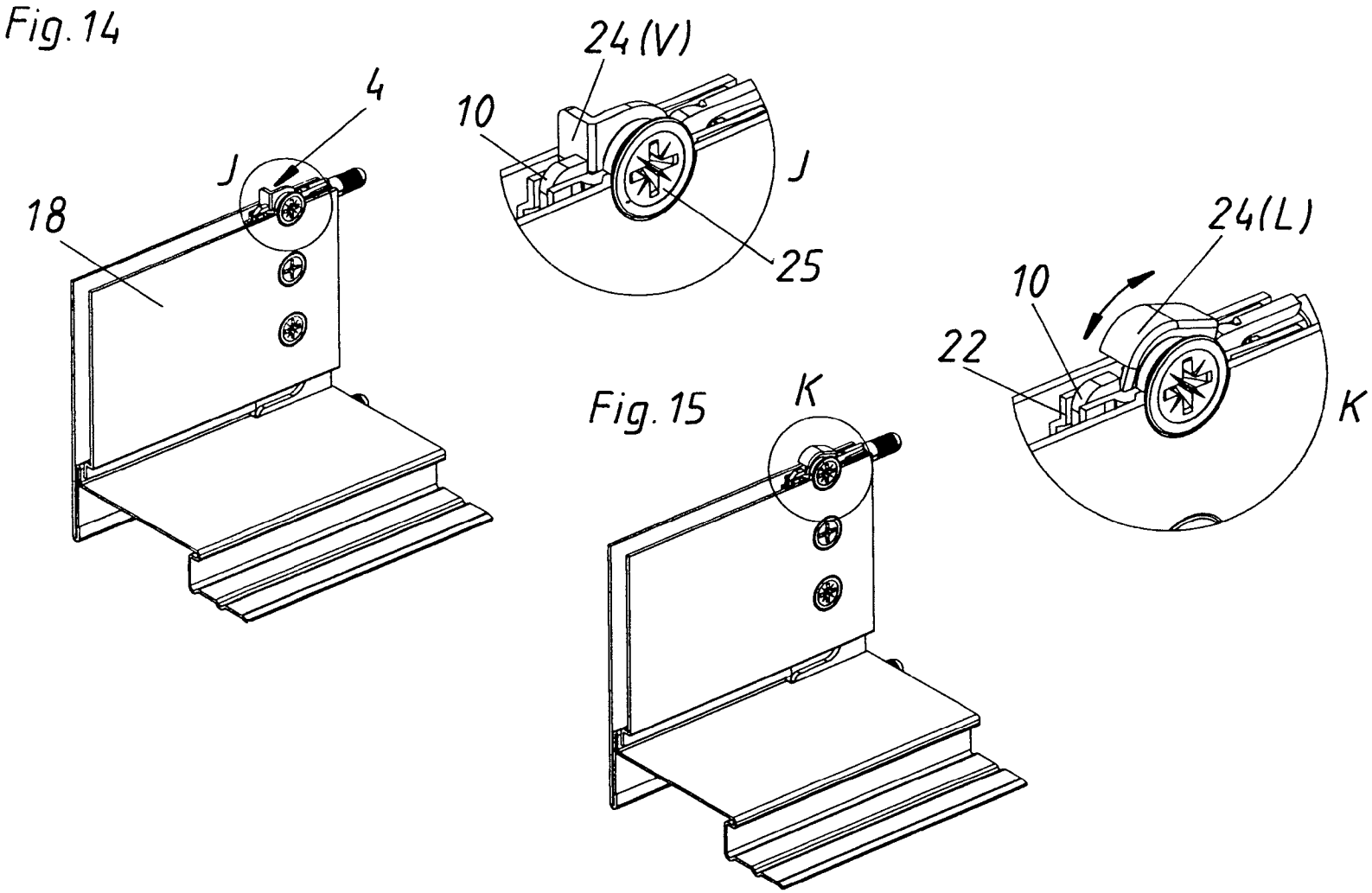
FIG. 14 shows the locking device in the locking position.
FIG. 15 shows the locking device in the release position.

FIG. 14 in the detail J shows the locking element 24 of the locking device 4 in the locking position V in the plate-shaped part 10. In contrast in detail K in FIG. 15 the locking element 24 is moved into the release position L by rotation of the locking screw 23 in the direction indicated by the right-hand arrow against the spring force of the locking spring 30.

Figure 17:
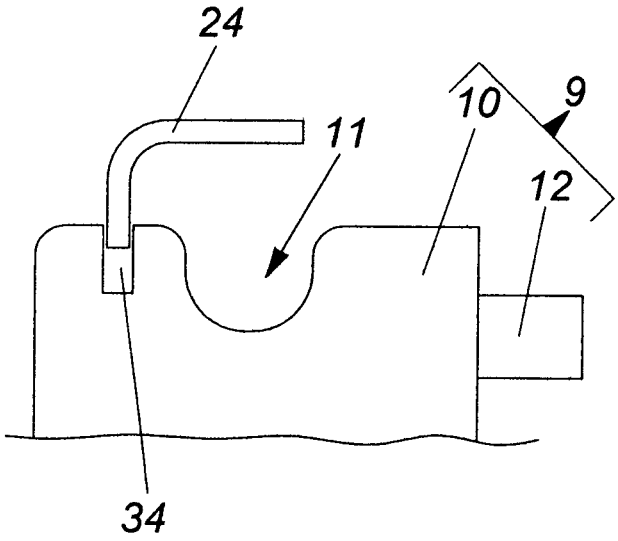
FIGS. 17 through 19 show (latching) positions of the connecting element in the connecting element.
Figure 18:
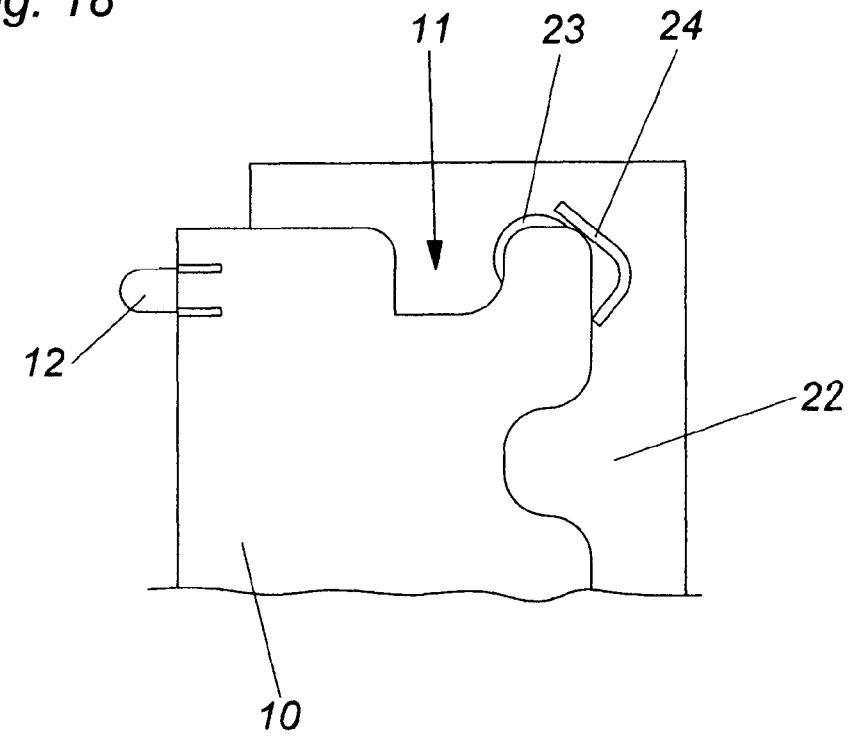
Figure 19:
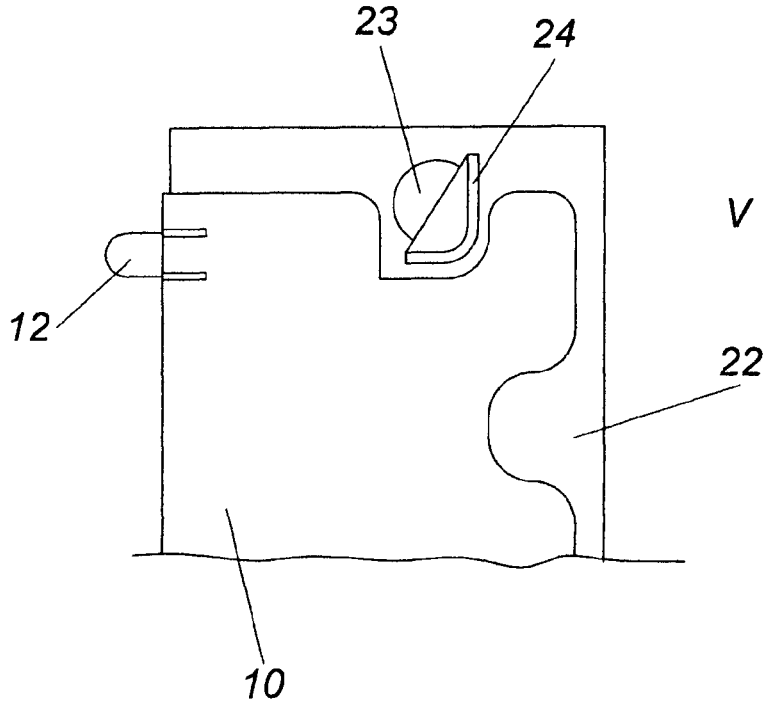

As can be seen in that respect in FIG. 17 locking of the locking device 4 can be effected by latching engagement of the locking element 24 in the locking groove 34 in the plate-shaped part 10. Sufficient clearance $S_{HR}$ is provided in that locking groove 34 for displacement in the heightwise direction HR, in which respect it is necessary to guarantee, in any heightwise position, that the locking element 24 can pass into the locking position V in the plate-shaped part 10. As can also be seen from FIG. 17 the locking element 24 can automatically snap into engagement upon introduction of the plate-shaped part 10, in which case the locking element 24 can slide along the upper end of the plate-shaped part 10 in part against the spring force of the locking spring 30. Preferably the recess 11 itself forms the locking groove in which the locking element 24 snaps in the locking position V. For that purpose FIG. 18 shows the position of the locking element 24 when the part 10 is pushed into the U-shaped profile member 22 and in that case the locking element 24 is rotated against the force of the spring 20 until, upon complete insertion of the part 10, the locking element 24 snaps into engagement in the upper recess 11 and passes into the locking position V. In other words the locking device 4 is in the form of a buttoned-in spring-loaded rotary lock. In general it should be noted that the locking device 4 can be provided singly or doubly (reference 4 and 4*a*) in the fixing device 6.

Figure 16:
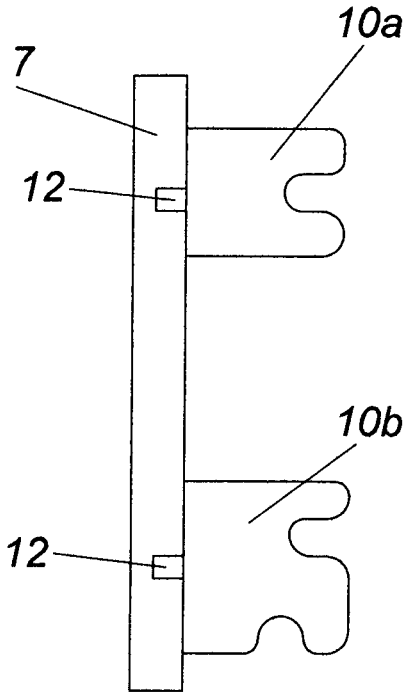
FIG. 16 shows a diagrammatic view of a two-piece plate-shaped part of a connecting element.

FIG. 16 shows that the same part of the connecting element 9 does not necessarily have to be in one piece. Rather that same part 10 can comprise two different portions 10*a* and 10*b* which however in the mounted condition at the front panel 7 are in a fixed, non-displaceable positional relationship with each other.

A substantial advantage of the adjusting elements 1 and 2 shown in this application is that they have so-called "memory effect". That is to say, when the connecting element 9, after release, is connected again to the other parts of the fixing device 6, the adjusting elements 1 and 2 by virtue of their self-locking action always remain in the position that was already previously adopted, whereby renewed positional setting does not have to be effected after removal and re-fitting of the front panel 7. Preferred variants of the present adjusting elements 1 and 2 are admittedly the worm 13 and the eccentric 14, but there is no intention to exclude other self-locking adjusting elements such as gear transmissions or other non-self-locking adjusting elements permitting displacement of the front panel 9 in a similar manner with respect to the drawer container 8 by way of one and the same part 10 of the connecting element 9.

The invention claimed is:

1. A drawer frame structure including a fixing device configured to fix a front panel to a drawer container in releasable and positionally adjustable relationship, the fixing device comprising:

a profile member for being connected to the drawer container;

a connecting element configured to be pre-mounted to the front panel, the connecting element being configured to releasably connect to the profile member;

a first adjusting element configured to adjust the position of the front panel in the heightwise direction; and a second adjusting element configured to adjust the position of the front panel in the lateral direction, wherein the first and second adjusting elements are configured to engage the connecting element in such a manner that the connecting element is releasable from the profile member without adjusting the first adjusting element and without adjusting the second adjusting element.

2. The drawer frame structure of claim 1, wherein the first adjusting element and the connecting element are configured such that actuation of the first adjusting element moves the connecting element in the lateral direction.

3. The drawer frame structure of claim 1, wherein the connecting element includes a substantially plate-shaped part formed as one piece, and the first adjusting element and the second adjusting element engage the substantially plate-shaped part.

4. The drawer frame structure of claim 3, wherein the substantially plate-shaped part has recesses, and the adjusting elements engage into said recesses.

5. The drawer frame structure of claim 3, wherein the substantially plate-shaped part is fixed in the front panel by holding extensions.

6. The drawer frame structure of claim 3, wherein the substantially plate-shaped part is fixed in the front panel by holding extensions, and the holding extensions are pegs.

7. The drawer frame structure of claim 3, wherein the second adjusting element is a worm and displacement of the worm moves the plate-shaped part in the lateral direction with respect to the container, wherein the first adjusting element is an eccentric and displacement of the eccentric moves the plate-shaped part in the heightwise direction with respect to the container.

8. The drawer frame structure of claim 3, wherein displacement of the second adjusting element moves the plate-shaped part in the lateral direction with respect to the container, and wherein displacement of the first adjusting element moves the plate-shaped part in the heightwise direction with respect to the container.

9. The drawer frame structure of claim 8, wherein there is clearance between the second adjusting element and the recess of the plate-shaped part in the heightwise direction and said clearance allows displacement of the first adjusting element in the heightwise direction.

10. The drawer frame structure of claim 8, wherein there is clearance between the first adjusting element and the recess of the plate-shaped part in the lateral direction and said clearance allows displacement of the second adjusting element in the lateral direction.

11. The drawer frame structure of claim 1, further comprising a locking device for releasably fixing the front panel to the drawer frame structure, and wherein the connecting element is releasable from the container by displacement of the locking device from a locking position into a release position.

12. The drawer frame structure of claim 11, wherein the locking device engages the connecting element.

13. The drawer frame structure of claim 11, wherein the first and second adjusting elements and the locking device are adapted to be rotatable, displaceable, and self-locking.

14. The drawer frame structure of claim 11, wherein the first and second adjusting elements and the locking device are adapted to be rotatable, actuable by a screwdriver, displaceable, and self-locking.

15. The drawer frame structure of claim 1, wherein the connecting element includes a peg for being inserted into the front panel and a plate member, the profile member has a U-shape which receives the plate member, wherein the first adjusting element and the second adjusting element engage the plate member, and wherein the first adjusting element and the second adjusting element are configured such that the first and second adjusting elements are retained with the profile member as the plate member is released from the profile member.

16. A drawer comprising:

a front panel;

a drawer container; and the drawer frame structure of claim 1, wherein the connecting element is attached to the front panel, wherein the front panel is releasably connectable to the drawer container by the drawer frame structure, and wherein the position of the front panel is adjustable relative to the drawer container in the heightwise direction by the first adjusting element, and the position of the front panel is adjustable relative to the drawer container in the lateral direction by the second adjusting element.

17. The drawer of claim 16, further comprising a container rail for fixing the drawer to an extension guide such that the drawer is movable with respect to a body of furniture, wherein the profile member is connected to and extends from the container rail.

18. An article of furniture comprising a furniture body; and the drawer of claim 16 slidably connected to the furniture body.

19. A drawer frame structure including a fixing device configured to fix a front panel to a drawer container in releasable and positionally adjustable relationship, the fixing device comprising:

a profile member for being connected to the drawer container;

a connecting element configured to be pre-mounted to the front panel, the connecting element having a plate member configured to releasably connect to the profile member;

a first adjusting element configured to adjust the position of the front panel in the heightwise direction;

a second adjusting element configured to adjust the position of the front panel in the lateral direction; and a locking device for releasably fixing the front panel to the drawer frame structure, wherein the connecting element is releasable from the profile member by displacement of the locking device from a locking position into a release position, wherein the plate member has recesses and the first adjusting element, the second adjusting element, and the lock device engage the recesses of the plate member, and wherein the recesses of the plate member are configured such that the connecting element is releasable from the profile member by displacing the locking device to the release position without adjusting the first adjusting element and without adjusting the second adjusting element.

20. The drawer frame structure of claim 19, wherein the first adjusting element and the second adjusting element are configured such that the first and second adjusting elements are retained with the profile member as the plate member is released from the profile member.

* * * * *